US006822253B1

(12) United States Patent
Martin et al.

(10) Patent No.: US 6,822,253 B1
(45) Date of Patent: Nov. 23, 2004

(54) RADIOPHARMACEUTICAL SHIPPING PIG WITH ENCAPSULATED LEAD SHIELDING

(75) Inventors: Matthew R. Martin, Remsenberg, NY (US); Kenneth A. Paladino, Mastic Beach, NY (US)

(73) Assignee: Biodex Medical Systems, Inc., Shirley, NY (US)

( * ) Notice: Subject to any disclaimer, the term of this patent is extended or adjusted under 35 U.S.C. 154(b) by 0 days.

(21) Appl. No.: 10/434,796

(22) Filed: May 9, 2003

(51) Int. Cl.[7] ..... G21F 5/00; G21F 5/018; G21K 1/00

(52) U.S. Cl. ..... 250/507.1; 250/506.1; 250/515.1; 250/505.1; 53/449; 206/364

(58) Field of Search ..... 250/505.1, 506.1, 250/507.1, 515.1; 206/364, 524.1; 53/449, 485; 220/23.87; 604/198; 29/426.5, 469, 426.3

(56) References Cited

U.S. PATENT DOCUMENTS 5,519,931 A * 5/1996 Reich ..... 29/426.3
RE36,693 E * 5/2000 Reich ..... 250/507.1
6,162,198 A * 12/2000 Coffey et al. ..... 604/198
6,425,174 B1 * 7/2002 Reich ..... 29/469
6,576,918 B1 * 6/2003 Fu et al. ..... 250/507.1
6,586,758 B2 * 7/2003 Martin ..... 250/515.1
2002/0178566 A1 * 12/2002 Reich ..... 29/426.5
2002/0195575 A1 * 12/2002 Martin ..... 250/506.1
2003/0222228 A1 * 12/2003 Fu et al. ..... 250/507.1

* cited by examiner

*Primary Examiner*—Nikita Wells
*Assistant Examiner*—Mary El-Shammaa
(74) *Attorney, Agent, or Firm*—Gibbons, Del Deo, Dolan, Griffinger & Vecchione

(57) ABSTRACT

Encapsulation of an inner facing surface of a lead shield of a radiopharmaceutical pig. The inner facing surface defines a chamber in which is inserted a radiopharmaceutical syringe. The encapsulation protects the inner facing surface against contamination due to leaks of the contents of the radiopharmaceutical syringe and further obviates the need for a sharps container to enclose the syringe during transport.

24 Claims, 3 Drawing Sheets

RADIOPHARMACEUTICAL SHIPPING PIG WITH ENCAPSULATED LEAD SHIELDING

BACKGROUND OF THE INVENTION

1. Field of the Invention

The present invention relates to shipping pigs for radiopharmaceuticals that use lead for radiation shielding. In particular, lead shielding between outer cases and inner plastic liners are enclosed and sealed.

2. Discussion of the Prior Art

Conventional shipping pigs for radiopharmaceuticals includes those that use lead for radiation shielding. Some have removable inner liners to hold the syringes containing the radiopharmaceutical. Such inner liners are inserted with outer cases of the radiopharmaceutical pigs.

It would therefore be desirable to provide a radiopharmaceutical pig that encloses and seals lead shielding between outer cases and inner plastic liners.

SUMMARY OF THE INVENTION

One aspect of the invention resides in encapsulation of an inner facing surface of a lead shield of a radiopharmaceutical pig. The inner facing surface defines a chamber in which is inserted a radiopharmaceutical syringe. The encapsulation protects the inner facing surface against contamination due to leaks of the contents of the radiopharmaceutical syringe and further obviates the need for a sharps container to enclose the syringe.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE DRAWING

Figure 1:
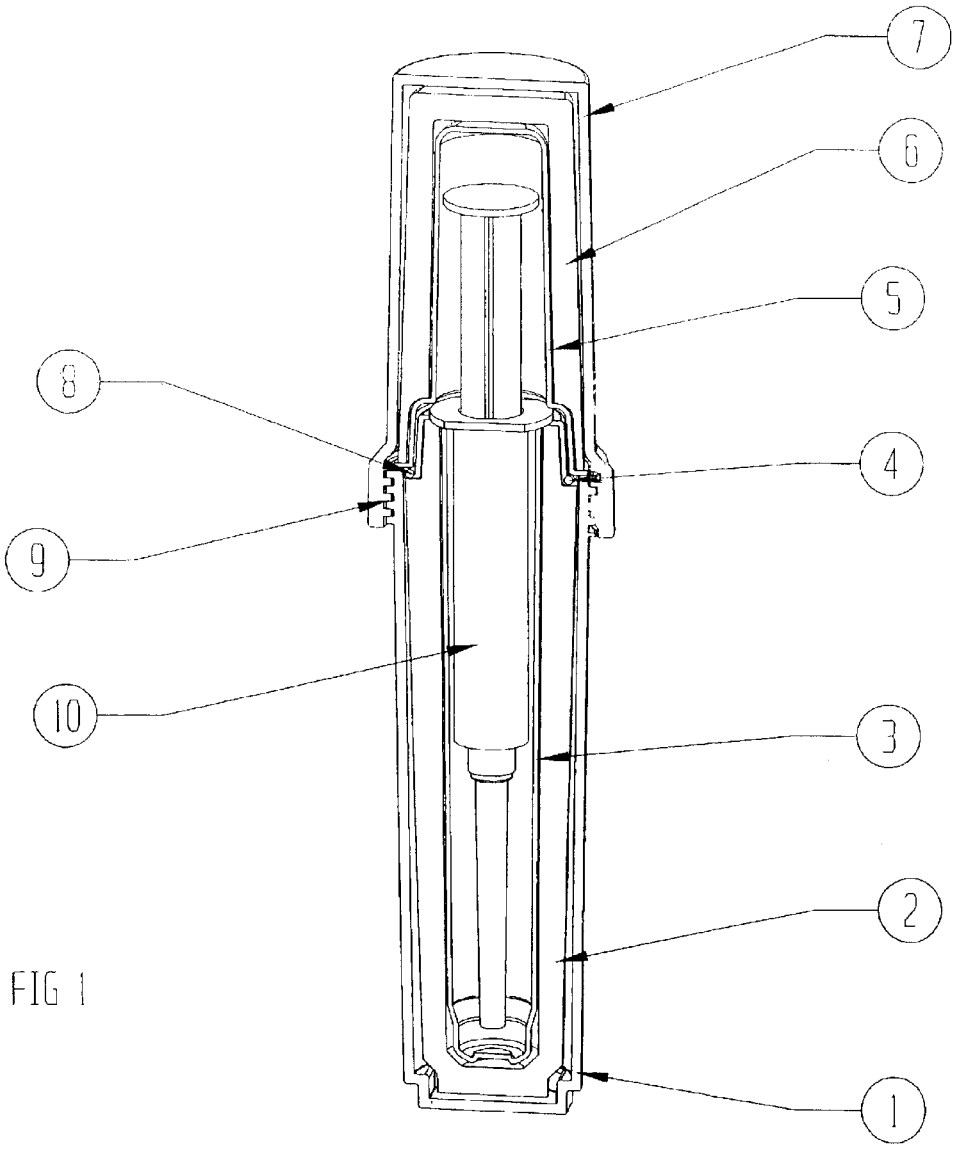
FIG. 1 shows a longitudinal cutaway view of a radiopharmaceutical pig in accordance with the invention.
Figure 2:
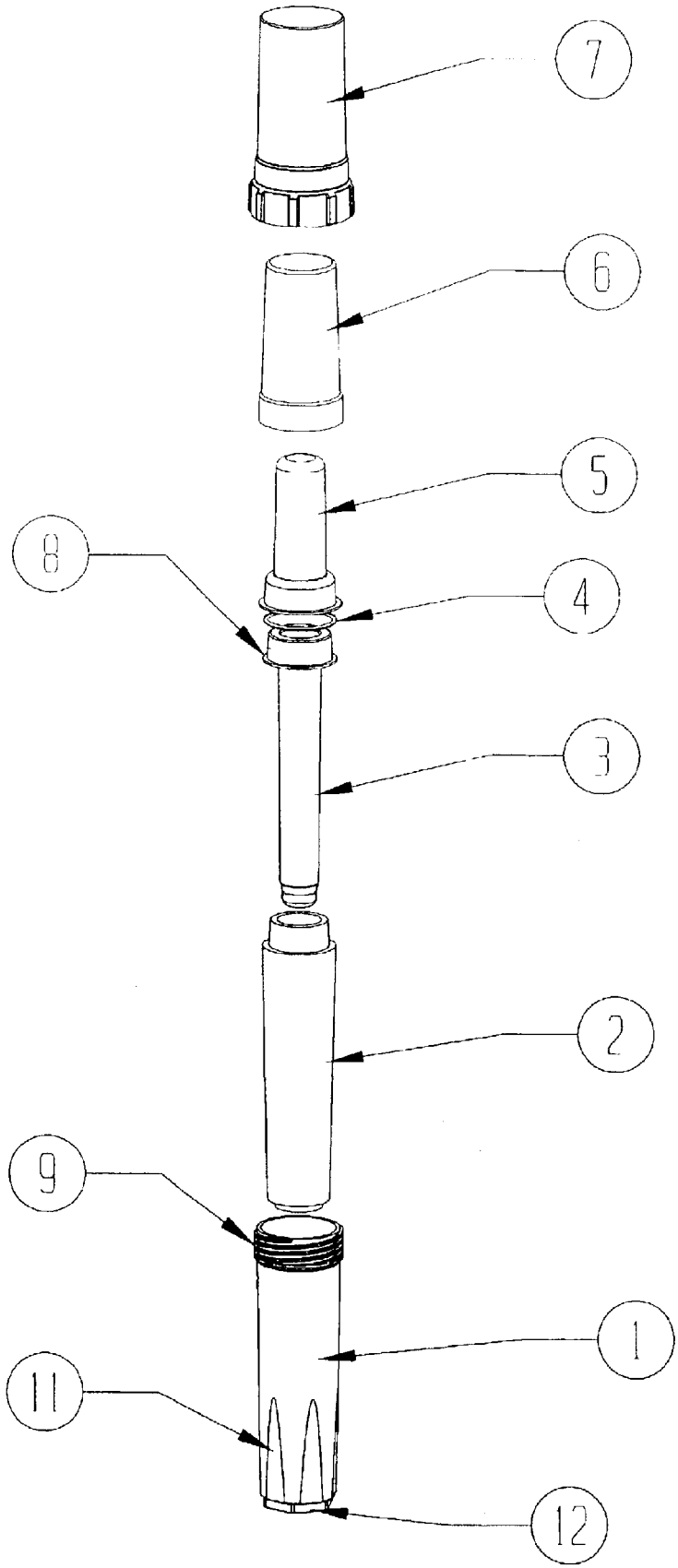
FIG. 2 is an exploded view thereof.
Figure 3:
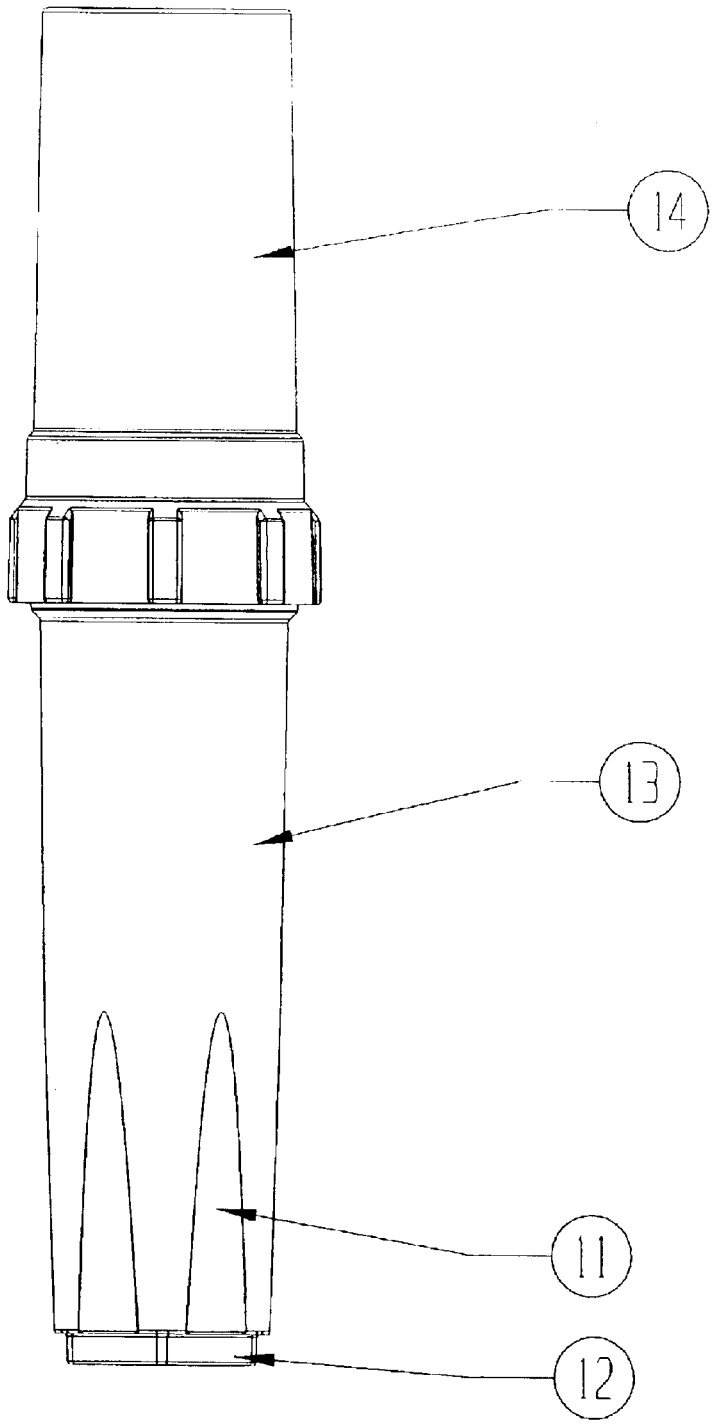
FIG. 3 is an elevation side view thereof.

Turning to the drawings, FIGS. 1 and 2 identify lower assembly components, namely, a lower case 1, a lower lead shield 2, a lower liner 3, and an O-ring 4, all which may be collectively considered part of a lower assembly 13. FIGS. 1 and 2 also identify upper assembly components, namely, an upper lead shield 5, an upper liner 6 and an upper case 7, all which may collectively be considered part of an upper assembly 14.

The lower case 1 may be made of plastic, metal or a combination of each. The lower lead shield 2 is securely attached to the lower case 1, such as with glue, epoxy, a laminate or heat sealing materials. A lower liner 3 is likewise securely attached to the lower lead shield 2 with an encapsulating material, such as with glue, epoxy, a laminate, or heat sealing materials, so that an inner facing surface of the lower lead shield 2 is completely covered and sealed, i.e., encapsulated by the lower liner 3. The O ring 4, which may be made of neoprene or other elastomer, is securely attached into a groove 8, such as with glue or epoxy. The groove 8 may be formed to accommodate the way that the lower liner 3 fits with the lower case 1.

The upper case 7 may be made of plastic, metal or a combination of both. The upper lead shield 6 is securely attached to the upper case 7, such as with glue or heat sealing materials. The upper liner 5 is securely attached to the upper lead shield 6 with an encapsulating material, such as glue, epoxy, a laminate or heat sealing materials, so that the lead of the upper lead shield 6 is completely covered and sealed, i.e., encapsulated.

The O-ring 4 seals the lower liner 3 to the upper liner 5 as the upper assembly 14 is screwed onto the lower assembly 13 using the threads 9. Each of the lower line 3 and the upper liner 5 may have outwardly directed flange surfaces that sandwich the O-ring 4 between them to seal a chamber defined by the lower and upper liners 3, 5. The threads 9 may be triple start threaded to reduce an amount of turns needed to screw the two assemblies 13, 14 together.

In addition, the lower case 1 has flats 11 that are molded to prevent the lower assembly 13 from rolling on a flat surface. There may be a configuration with at least one corner such as a hexagon shape 12 molded onto the bottom of the lower case 1 such that the hexagon shape 12 can be secured in a hexagon shaped hole or recess. This way the upper assembly 14 can be screwed to, or unscrewed from, the lower assembly 13 without the user holding onto the lower assembly. This greatly reduces the amount and duration of hand exposure to radiation, because the user no longer needs to hold onto the lower assembly during the screwing and unscrewing operations.

The syringe 10 contains a radiopharmaceutical and is placed into the lower liner 3 before the two halves of the upper and lower cases 1, 7 are screwed together by engaging thread connections. After the two halves have been screwed together, the syringe 10 is shipped filled within the two halves to a site. After arrival at the site, the syringe is removed from the two halves and used to administer the radiopharmaceutical from the syringe. When done, the empty syringe is replaced in the pig and then shipped back empty.

The two lead shields 2, 6 have edges that face each other that are configured to overlap and engage each other so as to completely shield against penetration of radiation at the joint between the two lead shields 2, 6. Thus, lower lead shield 2 may have a tubular projection in the edge that complements, but is of a reduced diameter, than a further tubular projection in the edge of the upper lead shield 5. The lower lead shield 2 may have a lower projection that fits within a complementary recess inside at the base of the lower case 1, As a result of encapsulating, the lower and upper lead shields 2, 6 are sealed and thereby protected by the lower and upper liners 3, 5 against contamination from any radiopharmaceutical remnants from the syringe 10 and against exposing the lead shields to cleansing fluids such as water when cleaning them. The lower and upper lines 3, 5 may be formed of plastic or metal material.

The syringe 10 may be entirely free of any sharps container surrounding it, because the lower and upper liners 3, 5 obviate the need for it. Indeed, a sharps container would not need to be used in the radiopharmaceutical pig of the present invention to provide sufficient protection of the lead shields against contamination by the discharge of any remnants from within the syringe 10, because the encapsulation provides sufficient protection. The lower and upper liners 3, 5 themselves may be formed of an encapsulating material that adheres or otherwise clings to secure itself to the lead shield to which it is in contact, such as when subjected to a sufficient amount of heat.

While the foregoing description and drawings represent the preferred embodiments of the present invention, it will be understood that various changes and modifications may be made without departing from the spirit and scope of the present invention.

What is claimed is:

1. A radiopharmaceutical pig apparatus, comprising:

two case halves secured to each other and defining a cavity;

two lead shields that define a chamber, the two lead shields being within the cavity, each lead shield being secured to a respective one of the two case halves; and at least one liner encapsulating and sealing an inner facing surface of at least one of the two lead shields, the inner facing surface defining a portion of the chamber, the liner being adhered to the inner facing surface with an adhering material, the chamber being configured to accommodate maintaining a radiopharmaceutical syringe in a stationary position within the confines of the chamber.

2. A radiopharmaceutical pig apparatus as in claim 1, further comprising the syringe within the confines of the chamber.

3. An apparatus of claim 1, wherein the adhering material is selected from a group consisting of a glue, an epoxy, and a laminate.

4. A radiopharmaceutical pig apparatus as in claim 1, further comprising a further liner encapsulating and sealing a further inner facing surface of the other of the two lead shields, the further inner facing surface defining a further portion of the chamber.

5. A radiopharmaceutical pig apparatus as in claim 1, wherein the two case halves have screw threads that engage each other to effect a screw thread engagement between the two case halves.

6. A radiopharmaceutical pig apparatus as in claim 4, further comprising an O-ring between the first-mentioned liner and the further liner, each of the first-mentioned liner and the further liner having outwardly directed flange surfaces between which is sandwiched the O-ring.

7. A radiopharmaceutical pig apparatus as in claim 1, wherein one of the case halves has a cylindrical exterior with a series of flat surfaces spaced apart from each other about a circumference of the cylindrical exterior.

8. A radiopharmaceutical pig apparatus as in claim 1, wherein the two lead shields are elongated and each have edges that face each other, the edges being configured to overlap and engage each other to prevent radiation leakage.

9. An apparatus of claim 1, wherein the two lead shields each have an outwardly extending flange with a further surface that faces opposite each other clear of the chamber, the liner encapsulating the surface of the at least one of the two lead shields.

10. A radiopharmaceutical pig apparatus, comprising:

two case halves secured to each other and defining a cavity;

two lead shields that define a chamber, the two lead shields being within the cavity, each lead shield being secured to a respective one of the two case halves; and at least one liner encapsulating and sealing an inner facing surface of at least one of the two lead shields, the inner facing surface defining a portion of the chamber, the chamber being configured to accommodate maintaining a radiopharmaceutical syringe in a stationary position within confines of the chamber the liner is being heat sealed.

11. A radiopharmaceutical pig apparatus, comprising:

two case halves secured to each other and defining a cavity;

two lead shields that define a chamber, the two lead shields being within the cavity each lead shield being secured to a respective one of the two case halves; and at least one liner encapsulating and sealing an inner facing surface of at least one of the two lead shields, the inner facing surface defining a portion of the chamber, the chamber being configured to accommodate maintaining a radiopharmaceutical syringe in a stationary position within confines of the chamber; and a syringe within the confines of the first-mentioned chamber and the further chamber, the syringe being free of any sharps container.

12. An apparatus of claim 11, wherein the liner is securely attached with a material selected from a group consisting of a glue, an epoxy, a laminate and heat sealing materials.

13. An apparatus of claim 11, wherein the two lead shields each have an outwardly extending flange with a further surface that faces opposite each other clear of the chamber, the liner encapsulating the face of the at least one of the two lead shields.

14. A radiopharmaceutical pig apparatus, comprising:

two case halves secured to each other and defining a cavity;

two lead shields that define a chamber, the two lead shields being within the cavity, each lead shield being secured to a respective one of the two case halves; and at least one liner encapsulating and sealing an inner facing surface of at least one of the two lead shields, the inner facing surface defining a portion of the chamber, the chamber being configured to accommodate maintaining a radiopharmaceutical syringe in a stationary position within confines of the chamber; one of the case halves having a bottom projection having at least one corner, which, when engaged, prevents the one of the case halves from rotating in unison with the other of the case halves.

15. A method of providing a radiopharmaceutical pig, comprising:

encapsulating and sealing an inner facing surface of a lead shield with a liner;

confining the lead shield and a further lead shield within a cavity defined by two case halves, each of the lead shield and the further lead shield being secured to a respective one of the two case halves, the lead shield and the further lead shield each defining a chamber a portion of which being bounded by the inner facing surface encapsulated by the liner;

inserting within the chamber a radiopharmaceutical syringe that is free of any sharps container; and securing the two case halves to each other.

16. A method as in claim 15, wherein the inserting includes placing a portion of the radiopharmaceutical syringe within the portion of the chamber that is bounded by the inner facing surface encapsulated by the liner, and accommodating a remaining portion of the radiopharmaceutical syringe in a remainder of the chamber.

17. A method as in claim 15, further comprising encapsulating the further lead shield with a further liner.

18. A method of claim 15, further comprising securely attaching the liner with a material selected from a group consisting of glue, an epoxy, a laminate and heat sealing materials.

19. A method of claim 15, wherein the two lead shields each have an outwardly extending flange with a further surface that faces opposite each other clear of the chamber, further comprising encapsulating the face of at least one of the two lead shields with the liner.

20. A method as in claim 15, further comprising preventing the two case halves from rolling along a flat surface although the case halves each have an cylindrical exterior by providing flats spaced apart from each other about a circumference of the cylindrical exterior of at least one of the two case halves.

21. A method as in claim 15, further comprising adhering the liner to the inner facing surface.

22. A method of providing a radiopharmaceutical pig, comprising:

encapsulating and sealing an inner facing surface of a lead shield with a liner;

confining the lead shield and a further lead shield within a cavity defined by two case halves, each of the lead shield and the further lead shield being secured to a respective one of the two case halves, the lead shield and the further lead shield each defining a chamber a portion of which being bounded by the inner facing surface encapsulated by the liner;

securing the two case halves to each other; and engaging a projection at a bottom of one of the two case halves so as to prevent rotation of the one of two case halves in unison with the other of the two case halves; the projection having at least one corner, and rotating the other of the two case halves relative to the one of the two case halves to either tighten or loosen the two case halves from each other.

23. A method of providing a radiopharmaceutical pig, comprising:

encapsulating and sealing an inner facing surface of a lead shield with a liner;

confining the lead shield and a further lead shield within a cavity defined by two case halves, each of the lead shield and the further lead shield being secured to a respective one of the two case halves, the lead shield and the further lead shield each defining a chamber a portion of which being bounded by the inner facing surface encapsulated by the liner;

securing the two case halves to each other, and heat sealing the liner.

24. A method of providing a radiopharmaceutical pig, comprising:

encapsulating and sealing an inner facing surface of a lead shield with a liner;

confining the lead shield and a further lead shield within a cavity defined by two case halves, each of the lead shield and the further lead shield being secured to a respective one of the two case halves, the lead shield and the further lead shield each defining a chamber a portion of which being bounded by the inner facing surface encapsulated by the liner; and securely attaching the liner with a material selected from a group consisting of glue, an epoxy, a laminate and heat sealing materials, the cavity being free of a sharps container.

* * * * *